United States Patent [19]

Harrison et al.

[11] Patent Number: 4,727,057

[45] Date of Patent: Feb. 23, 1988

[54] POLYESTER SUBBING LAYER FOR SLIPPING LAYER OF DYE-DONOR ELEMENT USED IN THERMAL DYE TRANSFER

[75] Inventors: Daniel J. Harrison, Rochester; Hsin-Chia Kan, Fairport; Noel R. Vanier, Rochester, all of N.Y.

[73] Assignee: Eastman Kodak Company, Rochester, N.Y.

[21] Appl. No.: 37,299

[22] Filed: Apr. 8, 1987

Related U.S. Application Data

[63] Continuation-in-part of Ser. No. 923,443, Oct. 27, 1986, abandoned.

[51] Int. Cl.[4] ..... B41M 5/26

[52] U.S. Cl. ..... 503/227; 8/471; 427/256; 428/195; 428/447; 428/480; 428/483; 428/704; 428/913; 428/914

[58] Field of Search ..... 8/470, 471; 427/256; 428/195, 207, 447, 480, 482, 483, 500, 704, 913, 914; 430/945; 503/227

*Primary Examiner*—Bruce H. Hess
*Attorney, Agent, or Firm*—Harold E. Cole

[57] ABSTRACT

A dye-donor element for thermal dye transfer comprising a poly(ethylene terephthalate) support having on one side thereof a dye layer and on the other side a subbing layer and a slipping layer, the subbing layer comprising a random, linear copolyester derived from at least one aromatic dibasic acid and at least one aliphatic diol.

20 Claims, No Drawings

POLYESTER SUBBING LAYER FOR SLIPPING LAYER OF DYE-DONOR ELEMENT USED IN THERMAL DYE TRANSFER

This invention relates to dye-donor elements used in thermal dye transfer, and more particularly to the use of a particular subbing layer, comprising certain polyester materials, for the slipping layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. A slipping layer on the back of the dye-donor element is therefore required to prevent the sticking which would otherwise occur. A subbing layer is also usually needed to promote adhesion between the support and the slipping layer. Many of the normal photographic subbing materials for polyester supports have been found to be unsuitable for dye-donor elements which have other requirements.

U.S. Pat. No. 4,559,273 relates to a dye-donor element having a slipping layer on the back side thereof, and wherein a primer layer is disclosed to be useful to improve the bonding strength. In column 4, it is stated that known primers can be used, and that the adhesion is improved when the primer layer is formed from acrylic resin, polyester resin and polyol/diisocyanate. No particular materials are disclosed, however.

Accordingly, this invention relates to a dye-donor element for thermal dye transfer comprising a poly(ethylene terephthalate) support having on one side thereof a dye layer and on the other side thereof a subbing layer and a slipping layer, and wherein the subbing layer comprises a random, linear copolyester derived from at least one aromatic dibasic acid and at least one aliphatic diol.

In a preferred embodiment of the invention, the dibasic acid is terephthalic acid, isophthalic acid, azelaic acid, p-phenylene bis-$\beta$-acrylic acid, sebacic acid or 3,5-dicarboxy-1-benzenesulfonic acid. In another preferred embodiment of the invention, the diol is 2,2-dimethyl-1,3-propanediol; 2,2'-oxydiethanol; ethyleneglycol; 1,4-butanediol; 1,6-hexanediol; 1,4-cyclohexanedimethanol; or 1,4-di($\beta$-hydroxyethoxy)cyclohexane.

In yet another preferred embodiment of the invention, the subbing layer comprises a random, linear copolyester derived from ethyleneglycol; 2,2-dimethyl-1,3-propanediol and terephthalic acid, or a random, linear copolyester derived from 1,4-butanediol; isophthalic acid; terephthalic acid and sebacic acid.

Examples of such copolyesters include Bostic 7650 ® (Bostik Chemical Group, Emhart Corp.) indicated by analysis to be a random copolyester derived from ethyleneglycol; 1,4-butanediol; 1,6-hexanediol; terephthalic acid and isophthalic acid (mole ratio of glycols: 58% $C_2$, 23% $C_4$, 19% $C_6$; mole ratio of acids: 40% terephthalic, 60% isophthalic); Bostik 7962 ® (Bostik Chemical Group, Emhart Corp.) (supplied as a 30% solids in toluene solution) indicated by analysis to be a random copolyester derived from 1,4-butanediol; isophthalic acid; terephthalic acid and sebacic acid (mole ratio of acids: 50% isophthalic, 35% terephthalic, 15% sebacic); a copolymer of partially sulfonated poly(diethyleneglycol isophthalate) such as

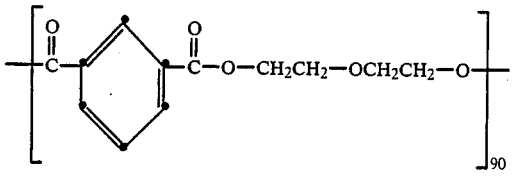

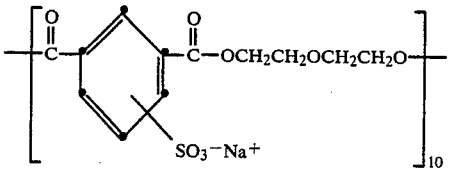

(Polyester 1)

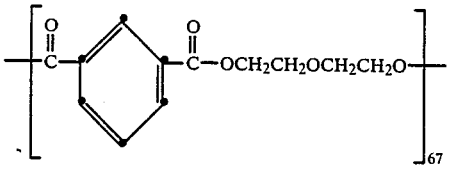

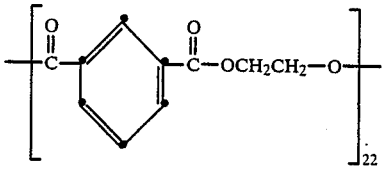

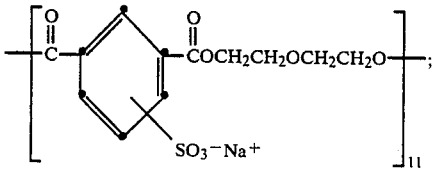

(Polyester 2)

a random copolyester derived from 2,2-dimethyl-1,3-propanediol; 2,2'-oxydiethanol and terephthalic acid (mole ratio of glycols: 50% $C_5$, 50% $C_4$):

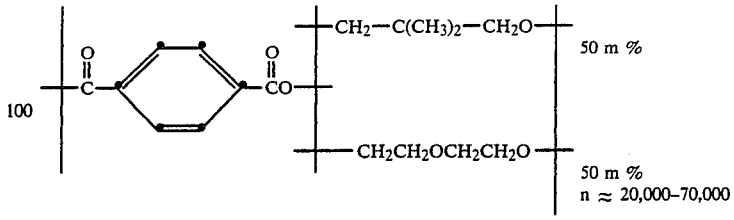

Polyester 3 a random copolyester derived from ethyleneglycol; 1,4-butanediol; 1,6-hexanediol; terephthalic acid and isophthalic acid (mole ratio of glycols: 50% $C_2$, 30% $C_4$, 20% $C_6$; mole ratio of acids: 40% terephthalic, 60% isophthalic):

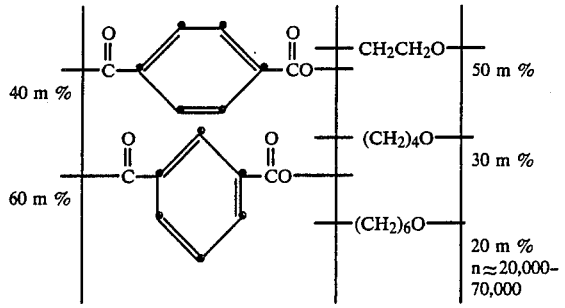

Polyester 4

Polyester 5: a random copolyester similar to Polyester 4 but mole ratio of glycols: 60% $C_2$, 30% $C_4$, 10% $C_6$; mole ratio of acids: 50% terephthalic, 50% isophthalic);

a random copolyester derived from ethyleneglycol; 1,4-butanediol; terephthalic acid and azelaic acid (mole ratio of glycols: 72.5% $C_2$, 27.5% $C_4$; mole ratio of acids: 52.5% terephthalic, 47.5% azelaic):

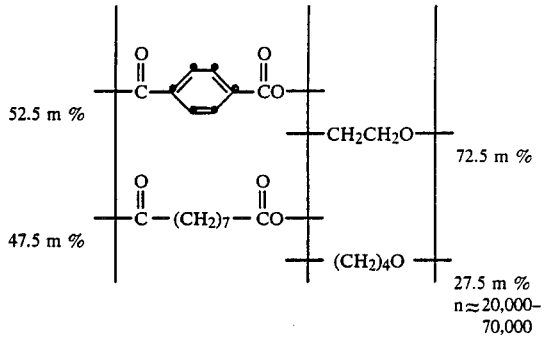

Polyester 6 a random copolyester derived from ethyleneglycol; 1,6-hexanediol; 1,4-cyclohexanedimethanol; terephthalic acid and azelaic acid (mole ratio of glycols: 25% $C_2$, 45% $C_6$, 30% $C_8$; mole ratio of acids: 60% terephthalic, 40% azelaic):

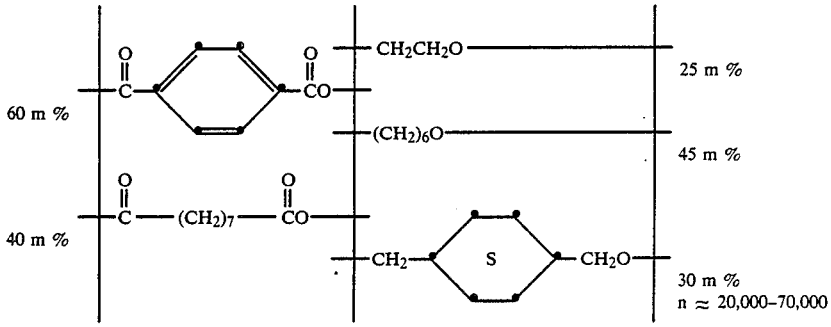

Polyester 7 a random copolyester derived from ethyleneglycol; 2,2-dimethyl-1,3-propanediol and terephthalic acid (mole ratio of glycols: 45% $C_2$, 55% $C_5$):

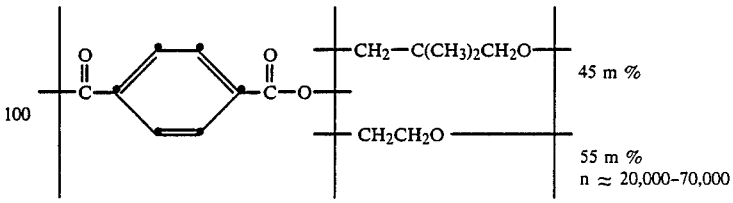

Polyester 8 a copolyester derived from 1,4-di(β-hydroxyethoxy)-cyclohexane and p-phenylene bis-β-acrylic acid:

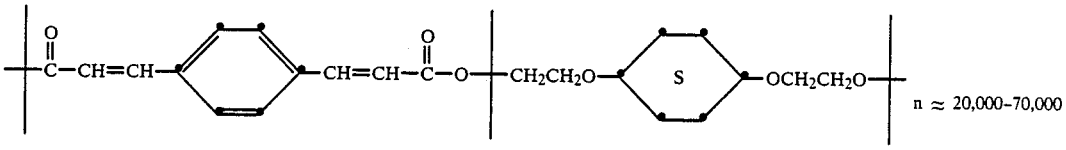

Polyester 9

Polyester 10: poly(ethylene terephthalate) modified with neopentylglycol; and Polyester 11: poly(hydroxyethoxycyclohexane-diethylbenzene diacrylate).

The subbing layer may be present in any concentration which is effective for the intended purpose. In general, good results have been obtained at concentrations of from about 0.3 to 1.0 g/m$^2$ of coated element.

In a preferred embodiment of the invention, the slipping layer comprises a lubricating material dispersed in a polymeric binder, the lubricating material being a partially esterified phosphate ester and a silicone polymer comprising units of a linear or branched alkyl or aryl siloxane, as disclosed and claimed in copending U.S. patent application Ser. No. 923,442, entitled "Silicone and Phosphate Ester Slipping Layer for Dye-Donor Element Used in Thermal Dye Transfer", by Henzel, Lum and Vanier, filed Oct. 27, 1986, the disclosure of which is hereby incorporated by reference.

In another preferred embodiment, the silicone material in the above slipping layer is present in an amount of from about 0.0005 to about 0.05 g/m$^2$, representing approximately 0.1 to 10% of the binder weight, the phosphate ester is present in an amount of from about 0.001 to about 0.150 g/m$^2$, representing approximately 0.2 to 30% of the binder weight, and the polymeric binder is a thermoplastic binder representing about 1 to about 80% of the total layer coverage.

Any silicone polymer can be employed in the preferred slipping layer described above providing it contains units of a linear or branched alkyl or aryl siloxane. In a more preferred embodiment, the silicone polymer is a copolymer of a polyalkylene oxide and a methyl alkylsiloxane. This material is supplied commercially by BYK Chemie, USA, as BYK-320®.

Any partially esterified phosphate ester can be employed in the preferred slipping layer described above. There may be employed, for example, the following:

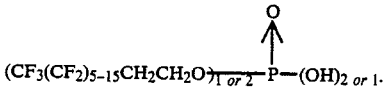

This material is supplied commercially by duPont as Zonyl UR®.

Any polymeric binder can be used in the slipping layer of the dye-donor element of the invention provided it has the desired effect. In a preferred embodiment of the invention, thermoplastic binders are employed. Examples of such materials include, for example, poly(styrene-co-acrylonitrile) (70/30 wt. ratio); poly(vinyl alcohol-co-butyral) (available commercially as Butvar 76® by Dow Chemical Co.; poly(vinyl alcohol-co-acetal); poly(vinyl alcohol-co-benzal); polystyrene; poly(vinyl acetate); cellulose acetate butyrate; cellulose acetate; ethyl cellulose; bisphenol-A polycarbonate resins; cellulose triacetate; poly(methylmethacrylate); copolymers of methyl methacrylate; poly(styrene-co-butadiene); and a lightly branched ether modified poly(cyclohexylene-cyclohexane-dicarboxylate):

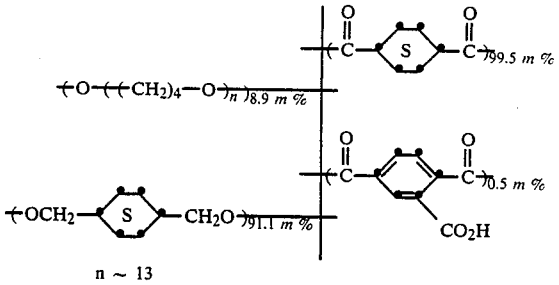

In a preferred embodiment of the invention, the thermoplastic binder in the slipping layer is a styrene-acrylonitrile copolymer.

The amount of polymeric binder used in the slipping layer described above is not critical. In general. the polymeric binder may be present in an amount of from about 0.1 to about 2 g/m$^2$, representing from about 1 to about 80% of the total layer coverage.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

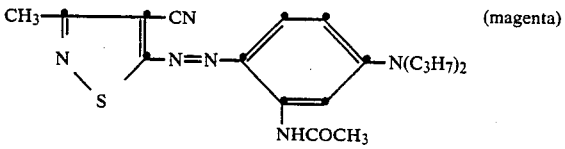

-continued

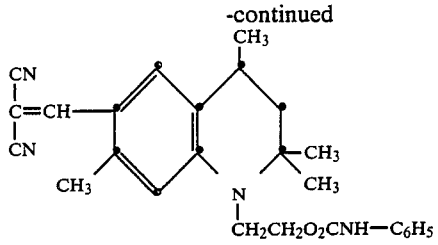

(yellow)

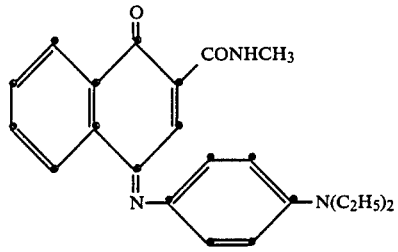

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A dye-receiving element was prepared by coating 2.9 g/m$^2$ of Makrolon 5705® polycarbonate resin (Bayer A.G.), 1,4-didecoxy-2,5-dimethoxybenzene (0.32 g/m$^2$) and FC-431® (3M Corp.) surfactant (0.016 g/m$^2$) using a solvent mixture of methylene chloride and trichloroethylene on a titanium dioxide-containing 175 μm poly-(ethylene terephthalate) support.

A cyan dye-donor element was prepared by coating on a 6 μm poly(ethylene terephthalate) support a dye layer containing the following cyan dye (0.28 g/m$^2$), duPont DLX-6000 Teflon ® micropowder (0.16 g/m$^2$), and FC-431 ® (3M Corp.) surfactant (0.009 g/m$^2$) in a cellulose acetate butyrate (14% acetyl, 38% butyryl) binder (0.50 g/m$^2$) coated from a toluene/methanol solvent mixture.

Cyan dye:

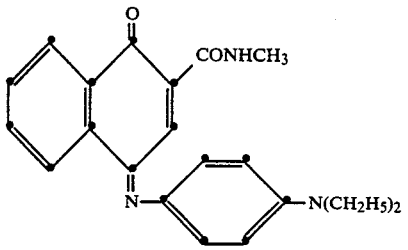

On the back side of the dye-donor was coated a subbing layer of 0.11 g/m$^2$ of Bostik 7650 ® described above coated from a toluene, 3-pentanone, and butanone solvent mixture. On top of this was coated a slipping layer of BYK-320 ® silicone (BYK Chemie, USA) described above (0.0054 g/m$^2$) and Zonyl UR ® (duPont Corp.) phosphate ester described above (0.022 g/m$^2$) in a poly(styrene-co-acrylonitrile) binder (70:30 wt. ratio) (0.54 g/m$^2$) from a 3-pentanone and methanol solvent mixture.

A control dye-donor element was prepared by coating the same slipping layer but without the subbing layer.

The back side of each dye-donor element (the side containing the slipping layer) was subjected to a tape adhesion test. The slipping layer was first carefully scored in an "X" pattern. A small area (approximately ¾ inch x 2 inches) of Scotch ® Magic Transparent Tape (3M Corp.) was firmly pressed by hand over the scored area of the dye-donor, leaving enough area free to serve as a handle for pulling the tape. Upon manually pulling the tape, ideally none of the slipping layer would be removed. Slipping layer removal indicated a weak bond between the support and the slipping layer. The following categories were established:

E—excellent (no layer removal)
G—good (a small amount of layer removal
F—fair (partial layer removal)
P—unacceptable (substantial or total layer removal)

The following results were obtained:

| Subbing Layer | Tape Test |
|---|---|
| None - Control | P |
| Bostik 7650 ® | E |

The subbing layer of the invention thus greatly improves the adhesion of the slipping layer to the support.

The dye side of each dye-donor element strip 1.25 inches (32 mm) wide was placed in contact with the dye image-receiving layer of the dye-receiver element of the same width. The assemblage was fastened in the jaws of a stepper motor driven pulling device. The assemblage was laid on top of a 0.55 inch (14 mm) diameter rubber roller and a TDK Thermal Head (No. L-133) was pressed with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated from 0 up to 8.3 msec to generate an "area test pattern" of given density. The voltage supplied to the print head was approximately 22 v representing approximately 1.6 watts/dot (13 mjoules/dot) for maximum power to the 0.1 mm$^2$ area pixel.

The dye-donor element of the invention containing the subbing layer passed through the thermal head with ease and produced images free from gross physical defects, while control dye-donors of this type have been found to be more susceptible to producing image defects.

EXAMPLE 2

(A) Cyan dye-donors of the invention were prepared as in Example 1, except that the back side was coated with a subbing layer of Bostik 7650 ® at the concentration listed in Table 1 coated from a butanone and cyclopentanone solvent mixture. On top of this was coated a slipping layer of BYK-320 ® silicone (BYK Chemie, USA) (0.011 g/m$^2$) and Gafac RA-600 ® (GAF Corp.) phosphate ester (0.043 g/m$^2$) in a poly(styrene-co-acrylonitrile) binder (70:30 wt. ratio) (0.54 g/m$^2$) from a propyl acetate, butanone and n-butyl acetate solvent mixture.

(B) Another dye-donor element of the invention was prepared similar to (A) except that the polyester subbing material was Polyester 1 described above coated from a methanol and water solution at the concentration listed in Table 1.

(C) Other dye-donor elements of the invention were prepared similar to (A) except that the polyester subbing material was Polyester 2 described above coated from a methanol and water solution at the concentrations listed in Table 1.

(D) Control dye-donor elements were prepared as in (A) by coating the same slipping layer but using the following vinyl polymer subbing layer: poly(acrylonitrile-co-vinylidene chloride-co-acrylic acid) (14:80:6 wt. ratio) coated from a butanone and cyclopentanone solvent mixture at the concentrations listed in Table 1.

The elements were then subjected to a tape test as in Example 1. The following results were obtained:

TABLE 1

| Subbing Layer | (g/m$^2$) | Tape Test |
|---|---|---|
| Bostik 7650 ® | 0.11 | E |
| Bostik 7650 ® | 0.16 | E |
| Bostik 7650 ® | 0.22 | E |
| Polyester 1 | 0.16 | E |
| Polyester 1 | 0.11 | E |
| Polyester 2 | 0.16 | E |
| Polyester 2 | 0.22 | E |
| Control Vinyl Polymer | 0.11 | P |
| Control Vinyl Polymer | 0.16 | P |
| Control Vinyl Polymer | 0.22 | P |

The above results show that the polyester subbing layers of the invention gave superior adhesion of the slipping layer to the support in comparison to a common photographic subbing material.

EXAMPLE 3

Preparation of Polyester 3

A random copolyester derived from 2,2-dimethyl-1,3-propanediol; 2,2'-oxydiethanol and terephthalic acid (mole ratio of glycols: 50% $C_5$, 50% $C_4$).

A mixture of dimethylterephthalate (194.2 g, 1.0 mole) 2,2-dimethyl-1,3-propanediol (62.4 g, 0.6 mole) and 2,2-oxydiethanol (91.2 g, 0.86 mole) in the presence of zinc acetate dihydrate (30 mg) and antimony trioxide (10 mg) was heated under nitrogen at 200° C. for 2 hrs during which time 66 ml of methanol was collected. The temperature was then raised to 240° C. for two hours and an additional 6.4 ml of methanol was collected. The temperature was finally kept at 260° C. for one hour, and an additional 2.2 ml of methanol was evolved (total methanol collected =74.6 ml). The polymerization was carried out by stirring the mixture at 270° C./0.20 mm Hg for two hrs until stirring became difficult. Upon cooling under nitrogen, the mixture yielded an amber, amorphous polymer; Tg, =42° C.

EXAMPLE 4

Example 1 was repeated except that the amount of BYK-320® silicone polymer in the slipping layer was 0.011 g/m$^2$ and the following subbing layer materials were employed:

Polyester 3
Polyester 4
Polyester 5
Polyester 6
Polyester 7
Polyester 8
Polyester 9
Bostik 7650® (Bostik Chemical Group, Emhart Corp.) described above
Bostik 7962® (Bostik Chemical Group, Emhart Corp.) described above and

COMPARISON POLYESTER

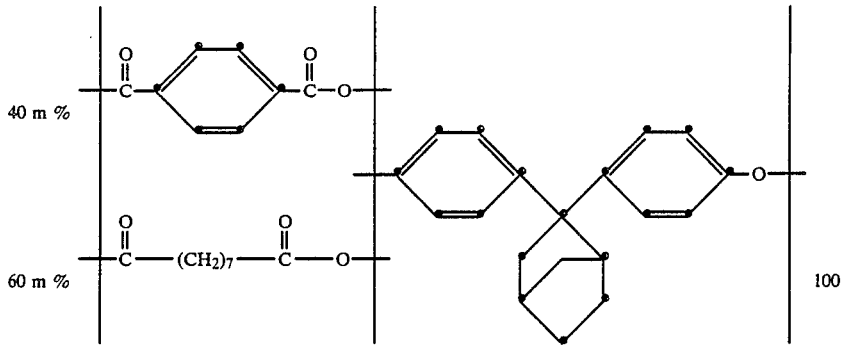

The following results were obtained:

| Subbing Layer | Tape Test |
|---|---|
| None - Control | P |
| Comparison Polyester | P |
| Bostik 7650® | E |
| Bostik 7962® | E |
| Polyester 3 | E |
| Polyester 4 | E |
| Polyester 5 | E |
| Polyester 6 | E |
| Polyester 7 | F-G |
| Polyester 8 | E |
| Polyester 9 | E |

The above results show that the polyester subbing layers of the invention gave superior adhesion of the slipping layer to the support in comparison to the control with no subbing layer and a comparison polyester material derived from an aromatic diol instead of an aliphatic diol according to the invention.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a poly(ethylene terephthalate) support having on one side thereof a dye layer and on the other side thereof a subbing layer and a slipping layer, the improvement wherein said subbing layer comprises a random, linear copolyester derived from at least one aromatic dibasic acid and at least one aliphatic diol.

2. The element of claim 1 wherein said dibasic acid is terephthalic acid, isophthalic acid, azelaic acid, p-phenylene bis-β-acrylic acid, sebacic acid or 3,5-dicarboxy-1-benzenesulfonic acid.

3. The element of claim 1 wherein said diol is 2,2-dimethyl-1,3-propanediol; 2,2'-oxydiethanol; ethyleneglycol; 1,4-butanediol; 1,6-hexanediol; 1,4-cyclohexanedimethanol; or 1,4-di(β-hydroxyethoxy)cyclohexane.

4. The element of claim 1 wherein said subbing layer comprises a random, linear copolyester derived from ethyleneglycol; 2,2-dimethyl-1,3-propanediol and terephthalic acid.

5. The element of claim 1 wherein said subbing layer comprises a random, linear copolyester derived from 1,4-butanediol; isophthalic acid; terephthalic acid and sebacic acid.

6. The element of claim 1 wherein said slipping layer comprises a lubricating material dispersed in a polymeric binder and said lubricating material comprises a partially esterified phosphate ester and a silicone polymer comprising units of a linear or branched alkyl or aryl siloxane.

7. The element of claim 6 wherein said polymeric binder is a styrene-acrylonitrile copolymer.

8. The element of claim 1 wherein said dye layer comprises sequential repeating areas of cyan, magenta and yellow dye.

9. In a process of forming a dye transfer image comprising (a) imagewise-heating a dye-donor element comprising a poly(ethylene terephthalate) support having on one side thereof a dye layer and on the other side thereof a subbing layer and a slipping layer, and (b) transferring a dye image to a dye-receiving element to form said dye transfer image, the improvement wherein said subbing layer comprises a random, linear copolyester derived from at least one aromatic dibasic acid and at least one aliphatic diol.

10. The process of claim 9 wherein said dibasic acid is terephthalic acid, isophthalic acid, azelaic acid, p-phenylene bis-β-acrylic acid, sebacic acid or 3,5-dicarboxy-1-benzenesulfonic acid.

11. The process of claim 9 wherein said diol is 2,2-dimethyl-1,3-propanediol; 2,2'-oxydiethanol; ethyleneglycol; 1,4-butanediol; 1,6-hexanediaol; 1,4-cyclohexanedimethanol; or 1,4-di(β-hydroxyethoxy)cyclohexane.

12. The process of claim 9 wherein said support is coated with sequential repeating areas of cyan, magenta and yellow dye, and said process steps are sequentially performed for each color to obtain a three-color dye transfer image.

13. In a thermal dye transfer assemblage comprising:

(a) a dye-donor element comprising a poly(ethylene terephthalate) support having on one side thereof a dye layer and on the other side thereof a subbing layer and a slipping layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said subbing layer comprises a random, linear copolyester derived from at least one aromatic dibasic acid and at least one aliphatic diol.

14. The assemblage of claim 13 wherein said dibasic acid is terephthalic acid, isophthalic acid, azelaic acid, p-phenylene bis-β-acrylic acid, sebacic acid or 3,5-dicarboxy-1-benzenesulfonic acid.

15. The assemblage of claim 13 wherein said diol is 2,2-dimethyl-1,3-propanediol; 2,2'-oxydiethanol; ethyleneglycol; 1,4-butanediol; 1,6-hexanediol; 1,4-cyclohexanedimethanol; or 1,4-di(β-hydroxyethoxy)cyclohexane.

16. The assemblage of claim 13 wherein said subbing layer comprises a random, linear copolyester derived from ethyleneglycol; 2,2-dimethyl-1,3-propanediol and terephthalic acid.

17. The assemblage of claim 13 wherein said subbing layer comprises a random, linear copolyester derived from 1,4-butanediol; isophthalic acid; terephthalic acid and sebacic acid.

18. The assemblage of claim 13 wherein said slipping layer comprises a lubricating material dispersed in a polymeric binder and said lubricating material comprises a partially esterified phosphate ester and a silicone polymer comprising units of a linear or branched alkyl or aryl siloxane.

19. The assemblage of claim 18 wherein said polymeric binder is a styrene-acrylonitrile copolymer.

20. The assemblage of claim 13 wherein said dye layer comprises sequential repeating areas of cyan, magenta and yellow dye.

* * * * *